United States Patent [19]

Green

[11] 4,389,810

[45] Jun. 28, 1983

[54] METERING TOY FOR SELECTING A SELF-PROPELLED VEHICLE OF GREATEST STRENGTH

[76] Inventor: Carmel H. Green, 2169 Carol St., Union City, Tenn. 38261

[21] Appl. No.: 371,972

[22] Filed: Apr. 26, 1982

[51] Int. Cl.[3] ..... A63H 17/05

[52] U.S. Cl. ..... 46/264; 46/206; 73/862.03

[58] Field of Search ..... 46/201, 202, 221, 248–251; 73/862.03; 213/75 TC

[56] References Cited

U.S. PATENT DOCUMENTS

| | | | |
|---|---|---|---|
| 3,146,547 | 9/1964 | Gabriel | 46/244 |
| 3,491,590 | 1/1970 | Watkins | 73/862.03 |
| 3,518,789 | 7/1970 | Domashovetz | 46/202 |
| 3,542,366 | 11/1970 | Schocker | 46/202 X |
| 3,589,055 | 6/1971 | Stormon | 46/202 X |
| 3,741,010 | 6/1973 | Leudtke | 73/862.03 |
| 4,113,255 | 9/1978 | Goldfarb et al. | 273/108 |

*Primary Examiner*—F. Barry Shay

*Attorney, Agent, or Firm*—Laurence R. Brown

[57] ABSTRACT

A load-measuring device for a self-propelled toy truck vehicle, or the like, comprises a movable platform having a set of wheels and a friction sled mat movable on the surface upon which the vehicle is propelled. The strength of the vehicle is measured by the distance the platform is moved. The platform has a weighted body thereon movable up an inclined ramp towards the mat thereby to increase friction and load on the vehicle. A winch assembly on the wheels winds up a cable that pulls the body up the ramp progressively as the platform is moved by the vehicle to thereby stop movement as the vehicle strength is matched by the load. Thus, the strength of the vehicle is measured as a distance over which the platform is moved.

3 Claims, 1 Drawing Figure

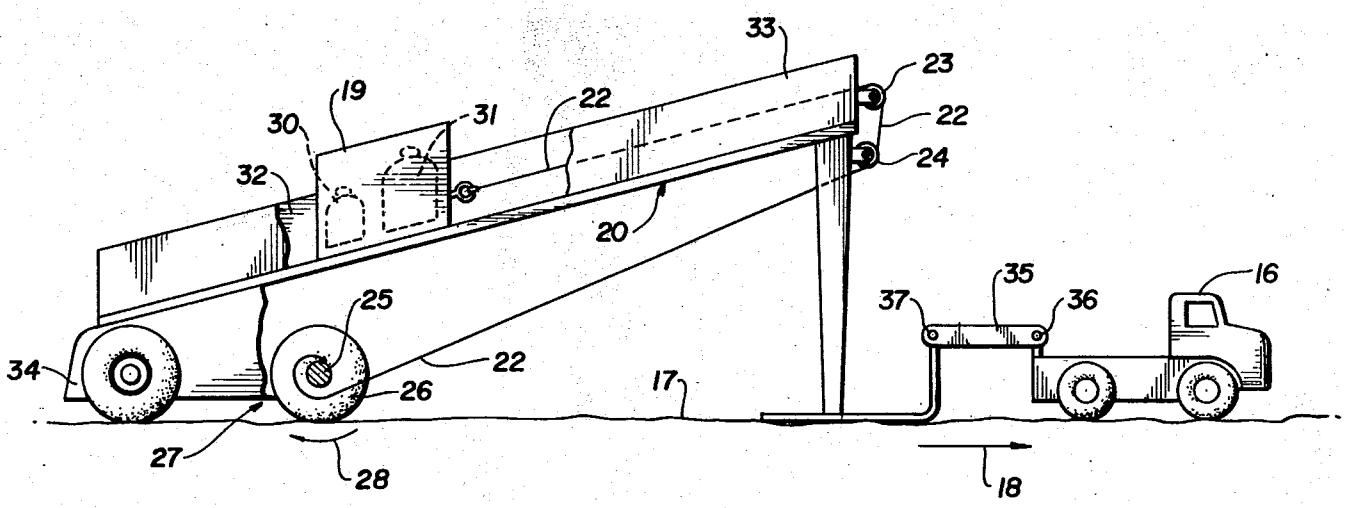
16
36
35
37
18
23
22
24
33
17
20
22
22
31
26
25
28
19
30
32
27
34

METERING TOY FOR SELECTING A SELF-PROPELLED VEHICLE OF GREATEST STRENGTH

TECHNICAL FIELD

This invention relates to toys an more particularly it relates to toys that competitively select a self-propelled vehicle, such as a toy truck, of greatest strength.

BACKGROUND OF THE INVENTION

Games are known for competitive comparison of the speed and maneuverability of self-propelled toy vehicles, such as race track assemblies. Also, games are known for competitive comparison of the skill in maneuvering a self-propelled toy vehicle, such as U.S. Pat. No. 4,113,255—Sept. 1978—A. E. Goldfarb et al. In this game objects are removed from a dump and carried up an inclined surface.

However, there are no known games for testing and indicating in a single run the strength of a self-propelled toy vehicle by determining the greatest load that can be carried by the competing toy vehicle. One of the problems of the strength test is the prior art requirement to run a number of competitive heats with increasing load increments in order to determine which vehicle has the greatest strength.

DISCLOSURE OF THE INVENTION

This invention provides a metering assembly for competitively determining the strengths of different self-propelled toy trucks and the like. It provides a sled arrangement that may be pulled by the self-propelled vehicle, and the winning strongest vehicle is the one that pulls the sled the greatest distance. The sled is constructed to increase the load on the vehicle as it moves the sled from a starting position, so that the strength competition is achieved in a single run heat by measuring the distance of the pull.

For increasing the load, a container body of predetermined weight, which can be supplemented by added weights to accomodate a wide range of vehicle designs, is pulled up an inclined ramp as the vehicle pulls the sled. The sled has a set of rear wheels and a front friction mat in contact with the surface upon which the vehicles are propelled. The mat is weighted down by the body as it is moved up the ramp to increase friction and loading. The load is progressively increased with travel of the sled by wrapping a cable about the wheel axle as a hoist that drags the weighted body up the inclined surface. Thus, the sled assembly is pulled until the load matches the maximum strength of the vehicle and the distance of the run is a measure of the strength.

Other features, objectives and advantages of the invention will be found throughout the description, drawing and claims.

BRIEF DESCRIPTION OF THE DRAWING

The single FIGURE of the drawing is a side elevation view of a load assembly for measuring the strength of a towing vehicle coupled thereto as the load is pulled over a suitable surface, partly broken away to show a winch assembly for increasing the load progressively by moving a weighted body up an inclined ramp as the assembly is moved by the vehicle.

THE PREFERRED EMBODIMENT

The preferred embodiment shown in the drawing comprises load means 15 that can be towed by a self-propelled toy truck vehicle 16, or the like, over a surface 17 on which the vehicle is propelled. As the load means 15 is towed in the direction of arrow 18 the weighted body 19 is moved up inclined ramp 20 by a winch assembly 21.

Thus, the cable 22 connected to weighted body 19 is passed around idler wheels 23, 24 or equivalent bearing surfaces, and is attached to axle 25 of the wheel set 26 so that it winds around the axle as shown at 27. This serves as a winch to wind up cable 22 and pull body 19 up the ramp 20 as the wheels turn in the direction of arrow 28 in contact with surface 17 under tow of vehicle 16.

The surface of the ramp 20 upon which the weighted body 19 is moved can be simply an inclined frictional surface such as a plastic molded piece. The body 19 is preferably an open top container box into which weights 30, 31 may be placed if necessary because of a powerful self-propelled vehicle 16. This container body 19 is bounded by rear rail 32 and front rail 33 to guide it up the ramp.

It is preferable that an elastic coupling member 35, such as a rubber band, be used to couple towing vehicle 16 to the load means 15 at hitches 36, 37 respectively. This serves to overcome the initial inertial friction of the sled mat 38 upon the surface 17 and permits start of movement without stalling self-propelled vehicle 16, usually a battery operated toy truck or tractor.

The framework 34 mounts the ramp 20 and journals the axles and wheel sets 25, 26, etc. for rotation therein.

As the load means 15 is moved forward in direction 18 under tow of the truck, and weighted body 19 moves up ramp 20, the weight vector on the friction sled mat 38 bearing on surface 17 increases. Thereby the load is increased progressively as wheel set 26 turns and body 19 moves frontward towards mat 38 up the inclined surface. The pulling of the body 19 by the winch assembly is also part of the load on the vehicle 16.

It is therefore seen that the load will progressively increase as the towing vehicle 16 moves forward until the point at which the vehicle strength is matched and it stalls out and stops. The distance of motion along the surface 17 in direction 18 is therefore a measure of the vehicle 16 strength.

Competition thus can take place between vehicles with score computed as a length, or using a starting line by means of a tape measure as a shot put is measured for example. If desired the surface 17 may be in the form of a track board with a known friction relationship to the surface of sled mat 38, and with scored lengths. Handicaps may be introduced in terms of calibrated weights 30, 31 added to weighted container body 19. Thus, the equipment afforded by this invention can be used to meter or calibrate vehicle strength or as a competitive game between contestants.

Those novel features believed descriptive of the spirit and nature of the invention are defined with particularity in the claims.

I claim:

1. A toy metering assembly for competitively determining the strengths of self-propelled toy vehicles, comprising in combination, a set of surface-engaging wheels coupled by an axle for rotation therewith, a framework mounting said axle for rotation therein, a sled having a friction mat adapted to slide upon a surface upon which the vehicles are propelled, a ramp coupled between the framework and sled providing an incline upwardly toward the sled, a body of predetermined weight movable over a pathway up said ramp, a cable affixed at respective ends thereof to said body and said axle adapted to wrap around said axle as the wheels are turned thereby to pull the sled up said ramp and increase the weight on said sled and thus the friction between the sled and the surface, and means for connecting a self-propelled toy vehicle to the sled for pulling the sled assembly and turning the wheels thereby to move the body up the ramp and gradually increase the load on the vehicle as the distance over which the sled is pulled increases.

2. The toy metering assembly defined in claim 1 having a toy vehicle coupled thereto by an elastic coupling member.

3. A toy assembly for determining the strength of a self-propelled toy vehicle, comprising in combination, load means that can be moved by the vehicle over a surface on which the vehicle is propelled, load-increasing means on the load means that cause the force needed to move the load means to be increased progressively as the load means is moved up a ramp by the vehicle wherein the load means has two wheels mounted on an axle for rotation with said two wheels, which wheels rotate on said surface when the load means is propelled by the vehicle, and said load-increasing means includes a winch assembly operable by the wheels to wind a cable about the axle to move said load-increasing means up the ramp for increasing the load on the vehicle as the load means is moved.

* * * * *